United States Patent [19]

Pawlikowski et al.

[11] Patent Number: 4,565,945

[45] Date of Patent: Jan. 21, 1986

[54] DEFLECTION LIMITING MEANS FOR CRT MASK SUPPORT MEANS

[75] Inventors: Stanley L. Pawlikowski, Seneca Falls; Carl W. Penird, Waterloo; Richard A. Tamburrino, Auburn, all of N.Y.

[73] Assignee: North American Philips Consumer Electronics Corp., New York, N.Y.

[21] Appl. No.: 493,493

[22] Filed: May 11, 1983

[51] Int. Cl.[4] ..... H01J 29/07; H01J 29/80

[52] U.S. Cl. ..... 313/404; 313/406; 313/407; 445/37

[58] Field of Search ..... 313/404, 406, 407, 402; 445/37

[56] References Cited

U.S. PATENT DOCUMENTS

| | | | |
|---|---|---|---|
| 3,521,104 | 7/1970 | Mears | 313/407 |
| 3,524,972 | 8/1970 | Cooper et al. | 313/405 |
| 3,601,650 | 8/1971 | Pappadis | 313/404 |
| 3,772,555 | 11/1973 | McKee et al. | 313/404 |
| 3,931,540 | 1/1976 | Kawamura | 313/404 |

*Primary Examiner*—David K. Moore
*Assistant Examiner*—K. Wieder
*Attorney, Agent, or Firm*—John C. Fox

[57] ABSTRACT

Resilient means on the mask frame of a cathode ray tube support the mask-frame assembly by mating with positioning studs embedded in the sidewall of the tube's viewing panel. To prevent permanent deformation of the resilient support means, mesas are formed adjacent to each means to beneficially limit their flexural movement necessitated by repeated insertion and removal of the mask-frame assembly during tube manufacturing.

9 Claims, 6 Drawing Figures

DEFLECTION LIMITING MEANS FOR CRT MASK SUPPORT MEANS

BACKGROUND OF THE INVENTION

1. Field Of The Invention

This invention relates to cathode ray tubes (CRT's) and more particularly to deflection limiting means for the resilient supports of a multi-opening electrode member positioned adjacent to the screen of the tube.

2. Description Of The Prior Art

Cathode ray tubes, such as those commonly utilized in color television and related display applications, conventionally employ a multi-opening structure, such as a shadow mask, positioned within the tube's viewing panel in spatial relationship to a patterned screen disposed on the interior surface of the panel.

The mask features a multi-apertured portion surrounded by a peripheral skirt, and is attached to the perimetrical wall of a supporting frame. This mask-frame assembly is supported by a plurality of elongated resilient support means located to mate with positioning studs embedded in and protruding from the sidewall of the panel.

Each of such mask-frame support means is conventionally formed by incorporating a transverse transitional bend into an elongated metallic spring member to demarcate a rigid basal seating portion and a longer arm-like resilient portion having a terminally-related stud-accepting aperture formed therein. Being thus formed, the two portions evidence an obtuse angular relationship when viewed along the bend axis. Thus, the seating portion, when suitably attached to the wall of the supporting frame, positions the resilient portion outwardly in a desired acute angular relationship with the frame.

To insert the mask-frame assembly into the panel, or to remove it, it is necessary to simultaneously move the several resilient portions of the respective support means inwardly toward the wall of the frame to clear the mating studs protruding from the panel sidewall. Such is accomplished by applying inwardly directed pressure against the resilient portions to achieve flexing of the resilient portions. Application of such pressure, exerts a stress on the transitional bends and seating portions of the support means. During this operation, the resilient portion often "bottoms out", meaning that the free end comes in contact with the wall of the frame or the sidewall of the mask. Since the mask is inserted into and removed from the panel several times during CRT fabrication, it has been found that repetitive bottoming-out of the support means tends to weaken or even deform the transitional bends therein, increasing the obtuse angle between the seating and resilient portions. Any deformation or flattening of the transitional bends, however small, results in a reduction of the spring bias of the individual support means against their respective studs. Such deformation of one or all of the support means may allow the mask to shift position relative to the patterned screen, deleteriously affecting image quality on the screen during CRT operation.

The terminal section of the resilient portion, when bottomed out, can also make contact with and damage the edge of the fragile apertured portion of the mask. This can occur when the support means are affixed on the mask frame at an acute angle to the edges of the frame, so that the resilient portions extend beyond the edges of the frame to positions adjacent to the edges of the apertured portion of the mask.

SUMMARY OF THE INVENTION

Accordingly, it is an object of the present invention to overcome the aforementioned disadvantages by providing an improved cathode ray tube, wherein the improvement relates to a structural modification of the framing member to limit deflection and prevent bottoming out of each support means when flexed during screen fabrication.

This structural modification or support deflection-limiting means is in the form of a raised portion of the sidewall portion of the mask framing member to provide a mesa-like formation. This formation is structured to provide at least regional fulcrum-like contact with the resilient arm portion of the support means when flexed.

The seating portion of the support means is affixed to the frame sidewall at a location substantially adjacent to the mesa formation. This positioning effects substantially superjacent orientation of the resilient arm portion over the mesa formation.

In one embodiment, the plateau of the mesa is slightly inclined toward the location of the seating portion of the support means, and preferably formed to substantially conform in contour to that of the adjacent flexed resilient arm portion of the support means.

In another preferred embodiment, a shallow pocket-like recess is formed inwardly in the sidewall portion of the mask framing member to accommodate at least the seating portion of the resilient support means. The mesa may be formed in the bottom of the recess, in which case the height of the mesa must be greater than the depth of the recess.

The mesa effectively limits the deflection of the resilient arm of the support means, thereby preventing the arm from bottoming out. Thus, it relieves stress on the transitional bend, thereby assuring maintenance of the desired obtuse angle between the seating and arm portions of the support means. Additionally, the resilient arm is inhibited from making damaging contact with the fragile edge of the apertured portion of the mask.

DESCRIPTION OF THE PREFERRED EMBODIMENT

For a more detailed understanding of the scope of the present invention, together with other and further objects, advantages, and capabilities thereof, reference is directed to the following disclosure and appended claims in conjunction with the accompanying drawing.

Figure 1:
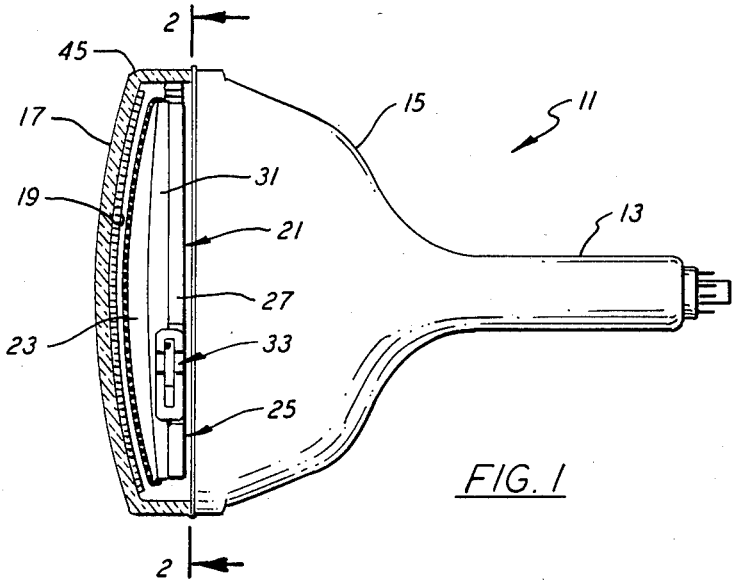
FIG. 1 is a side view of a cathode ray tube showing the panel portion in section.
Figure 2:
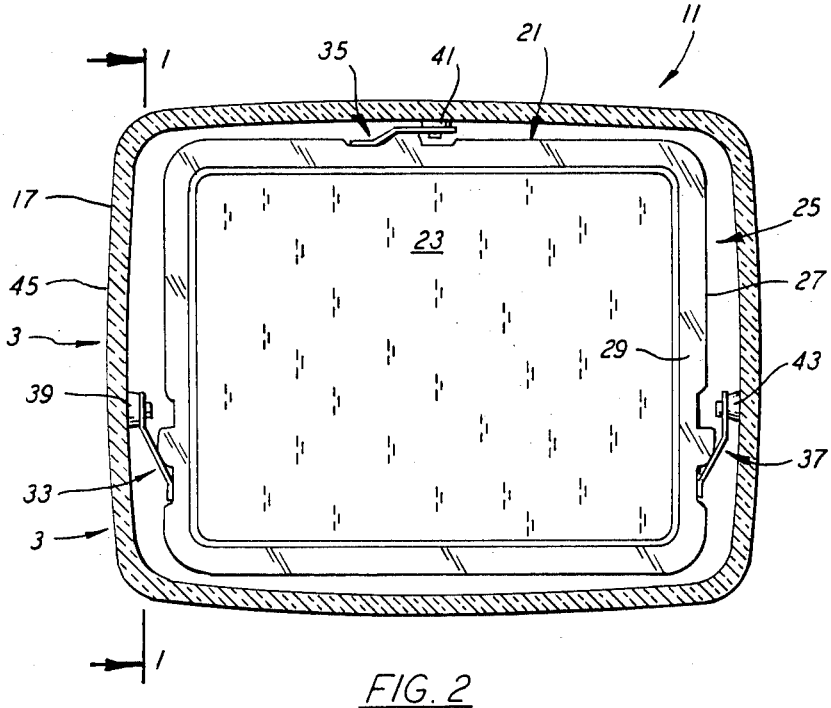
FIG. 2 is a plan view of the mask-panel assembly taken along the plane 2—2 in FIG. 1.

With reference to the drawings, there is shown in FIGS. 1 and 2 an exemplary color cathode ray tube 11 having an envelope enclosure comprised of an integration of neck 13, funnel 15, and viewing panel 17 portions. Disposed on the interior surface of the viewing panel is a discretely patterned cathodoluminescent screen 19 formed of a repetitive array of color-emitting phosphor components in keeping with the state of the art. A shadow mask assembly 21 is oriented within the viewing panel 17 in spatial relationship to the patterned screen 19.

The shadow mask assembly 21, which is shown as being of substantially rectangular shaping, is a metallic member comprised of a thin gauge multi-apertured forward mask portion 23 attached to a heavier gauge perimetrical supporting frame 25 having a continuous sidewall 27 with an integral rear-oriented instanding ledge 29 thereabout. The apertured portion is conventionally formed to have a peripheral skirt 31 which is seated on and affixed to the wall 27 of the supporting frame 25.

The mask assembly 21 is spatially located within the panel portion 17 by a plurality, in this instance three, of spacedapart support means 33, 35, and 37, affixed to the sidewall 27 of the supporting frame 25. These several support means are fashioned to mate with respective positioning studs 39, 41, and 43, which are partially embedded in the wall 45 of the viewing panel.

Figure 3:
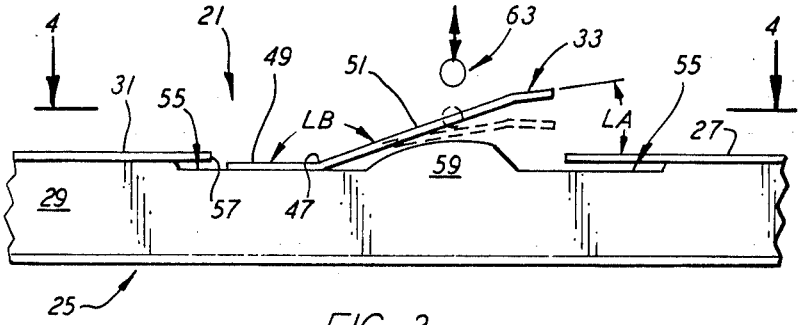
FIG. 3 is an enlarged localized view of one of the mask support means referenced by lines 3—3 in FIG. 2.
Figure 4:
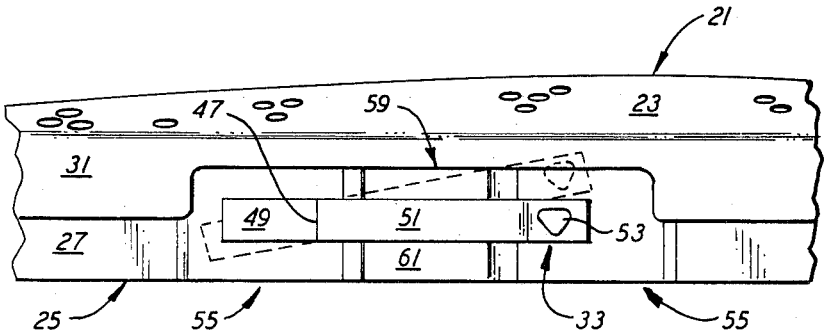
FIG. 4 is another view of the section illustrated in FIG. 3 taken along the plane 4—4 in FIG. 3.
Figure 5:
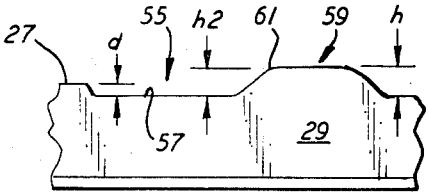
FIG. 5 is a localized view of the basic structure shown in FIG. 3.

Each of the support means 33, 35, and 37 is conventionally formed of a composite metallic material to effect positioning compensation for temperature differentials encountered during tube warm-up. As illustrated in FIGS. 3 and 4, each of such metallic members is of elongated shape incorporating an off-center transverse transitional bend 47 therein to form an obtuse angle ∠B between a basal seating portion 49 and a longer opposed arm-like resilient portion 51 having terminally-related stud-accepting aperture 53 formed therein. As shown in FIG. 3, the resilient support arm 51 forms an acute angle ∠A with the frame sidewall 27.

It is important that the initial value of obtuse angle ∠B in each support means be maintained after the several mask insertions and removals during screen formation, as this value determines the subsequent amount of spring-loaded support effected when the arm is flexed against the supporting studs as shown in FIG. 2. Bottoming-out flexure of the support means during repeated insertion of the mask into and removal of the mask from the panel, tends to deleteriously alter the values of primary angle ∠B and resultant angle ∠A.

An important object of the invention is to eliminate deformation of obtuse angle ∠B by providing means for preventing bottoming-out of the support means. With particular reference to FIGS. 3 through 6, structural modifications are made in the sidewall of the mask-supporting frame at each support means location to provide the desired improvement.

The structural modifications at the location of support means 33 will be treated as exemplary of the modifications effected at all of the several support locations. A shallow pocket-like recess 55, having a bottom 57, is formed inwardly in the sidewall portion 27 of the supporting frame 25. This recess evidences an area and a depth "d" that are sufficient to accommodate at least the support seating portion 49. Adjacent to the location of this seating portion, discrete means in the form of a mesa is provided to limit deformation and prevent permanent deformation of the support means resulting from flexures encountered during screen fabrication. As shown in FIG. 3, and again in FIG. 5, a portion of the bottom of the recess is raised to provide mesa 59 which evidences a plateau 61. As illustrated, the mesa has a height "h" that is greater than the depth "d" of the recess. Such is necessary to achieve the desired limitation of deflection. In this embodiment, the mesa 59 is oriented in substantially the central area of the recess, but such location is not to be considered limiting.

The plateau 61 of the mesa is slightly inclined with the lesser height "$h^2$" thereof being adjacent to the fixed location of the support seating portion 49. The plateau evidences a contour that substantially conforms to that of the adjacent portion of the flexed arm 51, which is in substantially superjacent orientation with mesa 59. This advantageous conformance is illustrated in FIG. 3, wherein flexure activation means 63, either manually or mechanically operated, is pressed against arm 51 to effect substantial conformance of the arm over the plateau 61, as indicated in phantom. It is evident that flexed arm 51 is supported by a major portion of the formed surface of the plateau 61. A minimum of stress is thus exerted on the obtuse angle-forming bend 47 and no permanent deformation results.

Figure 6:
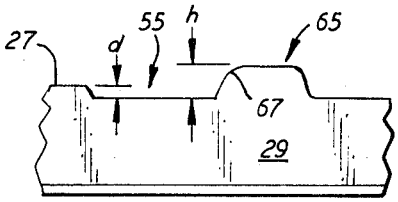
FIG. 6 is a localized view of another embodiment of the invention observed in an orientation similar to that of FIG. 3.

Another embodiment of the invention, as shown in FIG. 6, utilizes a smaller modified mesa formation 65 which employs a more rounded and limited arm-supporting region 67. This structure, while providing for less contact than in the first embodiment, is nevertheless sufficient to achieve the desired result. In this embodiment, recess 55 is located adjacent to the rounded side of the mesa 65, and has sufficient area to accommodate the seating portion 49 of support 33.

An additional benefit of the mesa-type formation is obtained when the mask support means 33 are affixed to the sidewall 27 of the mask frame in an angled position, as phantomed in FIG. 4. In such situations, flexure of the resilient arm 51 against the mesa 59 prevents the arm from making contact with and possibly damaging the fragile mask skirt portion 31.

While there have been shown and described what are at present considered to be the preferred embodiments of the invention, it will be obvious to those skilled in the art that various changes and modifications may be made therein without departing from the scope of the invention as defined in the appended claims.

We claim:

1. An improvement in a cathode ray tube having a viewing panel with face and sidewall portions and a shadow mask-frame assembly positioned adjacent the inner screen-supporting surface of the face portion, a plurality of spaced apart support means fixedly oriented on a perimetrical sidewall portion of the frame in a manner to mate with positioning studs embedded in and protruding from the sidewall portion of the viewing panel, each of said support means being an elongated metallic member incorporating an off-center transverse transitional bend therein to demarcate a basal seating portion from a longer integrally opposed arm-like resilient portion having a terminally-related stud accepting aperture formed therein, said improvement comprising:

a structural modification of the perimetrical sidewall portion of the mask framing member in the region of each support means in the form of a localized outwardly raised portion of said sidewall under the resilient portion and adjacent the seating portion of each support means for limiting deflection of the resilient portion and preventing permanent deformation of the support means during tube fabrication.

2. The improved cathode ray tube according to claim 1 wherein said raised portion is in the form of a mesa having a plateau.

3. The improved cathode ray tube according to claim 2 wherein said plateau is inclined toward the seating portion of said support means.

4. The improved cathode ray tube according to claim 2 wherein said plateau is formed to substantially conform to the contour of the adjacent portion of the resilient portion of said support means when flexed.

5. The improved cathode ray tube according to claim 2 wherein said plateau is formed to provide at least a region of fulcrum-like contact with the resilient portion of said support means when flexed.

6. The improved cathode ray tube of claim 1 wherein a shallow pocket-like recess is located in the sidewall portion of said framing member in the region of each support means, said recess having a planar bottom portion and a depth sufficient to accommodate at least the seating portion of said support means.

7. The improved cathode ray tube according to claim 6 wherein said raised portion is located in the recess and has a height greater than the depth of said recess.

8. The improved cathode ray tube according to claim 7 wherein said raised portion is oriented in substantially the central area of said recess.

9. The improved cathode ray tube according to claim 6 wherein the raised portion is located substantially adjacent to said recess.

* * * * *